US006081968A

United States Patent [19]

Walker et al.

[11] Patent Number: 6,081,968

[45] Date of Patent: Jul. 4, 2000

[54] DOOR HINGE ASSEMBLY WITH FIXED PIVOT PIN FOR AN ENCLOSURE FOR ELECTRICAL APPARATUS AND ENCLOSURE INCORPORATING SAME

[75] Inventors: Steven Dale Walker, Arden; William Edward Wilkie, II, Fletcher, both of N.C.

[73] Assignee: Eaton Corporation, Cleveland, Ohio

[21] Appl. No.: 09/188,481

[22] Filed: Nov. 9, 1998

[51] Int. Cl.[7] ..... E05D 5/02

[52] U.S. Cl. ..... 16/252; 16/262; 16/389

[58] Field of Search ..... 16/252–254, 262–264, 16/270, 389, 387, 382; 312/329, 326; 361/645, 651–652, 657, 667, 673; 220/844

[56] References Cited

U.S. PATENT DOCUMENTS

| | | | |
|---|---|---|---|
| 1,467,190 | 9/1923 | Muhlenbruch | 16/253 |
| 2,913,200 | 11/1959 | Paine, Jr. et al. | 16/261 |
| 3,021,555 | 2/1962 | Hogedal | 16/261 |
| 4,400,847 | 8/1983 | Farber | 16/262 |
| 4,629,265 | 12/1986 | Chester | 312/329 |
| 4,672,714 | 6/1987 | Bos | 16/262 |
| 4,873,745 | 10/1989 | Ramsauer | 16/264 |

*Primary Examiner*—Chuck Y. Mah
*Attorney, Agent, or Firm*—Martin J. Moran

[57] ABSTRACT

A hinge assembly for an enclosure for electrical apparatus includes a hinge pin non-rotationally fixed to either the door or the door jamb. A hinge housing is secured to the other of the door and the door jamb and clamps the hinge pin with a compression fit. The housing includes an angle member forming an internal corner and a clamping member having clamping flanges forming at least one, and preferably a pair, of spaced apart, external corners with corner recesses smaller in radius than the hinge pin in which the hinge pin is received and wedged into the internal corner of the angle member. Clamp tabs on the clamping flanges are secured to one of the flanges on the angle member such as by rivets to produce the compression fit. An elongated flat body on the clamp member and a mounting flange on the angle member abut and are secured to the other of the door and door jamb by common mounting fasteners.

16 Claims, 4 Drawing Sheets

DOOR HINGE ASSEMBLY WITH FIXED PIVOT PIN FOR AN ENCLOSURE FOR ELECTRICAL APPARATUS AND ENCLOSURE INCORPORATING SAME

BACKGROUND OF THE INVENTION

1. Field of the Invention

This invention relates to a hinge assembly for doors on enclosures for electrical apparatus such as switchgear, and to such enclosures incorporating the hinge assembly. More particularly, it relates to a hinge assembly especially suitable for wide doors in which the hinge pin is fixed to either the door or the door jamb and is clamped by a hinge housing secured to the other component of the enclosure.

2. Background Information

The enclosures for electrical apparatus, such as for instance switchgear, include doors which are often short and wide. Such doors can have a width which is as much as four to five times the height of the door. Conventional door hinges, such as those with a hinge pin extending through aligned bores in interleaved bosses on flanges secured to the door and the door jamb, have inherent tolerances that produce excessive sag in the wide doors.

There is a need, therefore, for an improved hinge assembly for such enclosures for electrical apparatus, and the enclosures incorporating them, which eliminates the excessive sag commonly found in current equipment.

There is a related need for such hinge assemblies and enclosures which are simple and easy to manufacture and install.

There is a particular need for such hinge assemblies and enclosures which do not require machining or time consuming alignment to eliminate the excessive sag.

SUMMARY OF THE INVENTION

These needs and others are satisfied by the invention which is directed to a hinge assembly comprising of a hinge pin non-rotationally fixed to either the door or the door jamb and a hinge housing fixed to the other of the door and door jamb clamping against the hinge pin with a compression fit which permits relative rotation between the hinge pin and the hinge housing. This hinge housing includes a first member and a second member which clamp the hinge pin between them. The first housing member is an angle member forming an internal corner. The second member is a clamp member which clamps the hinge pin into the internal corner of the angle member. The clamp member has an external corner which nests into the internal corner of the angle member. A corner recess in this external corner which is smaller than the diameter of the hinge pin wedges the hinge pin into the external corner of the angle member. Preferably, the corner recess in the clamping member is an open circle with a diameter smaller than the diameter of the hinge pin.

Preferably, the clamp member has a flat elongated body with first and second clamping flanges projecting from opposite ends and forming spaced apart external corners with aligned corner recesses which nest with the internal corner of the angle member to clamp the hinge pin at two spaced apart locations. Clamp tabs provided on the clamping flanges adjacent the corner recesses are secured to the angle member adjacent the internal corner by clamping fasteners. These clamp tabs are substantially perpendicular to both the clamping flanges and the flat elongated body of the clamp member.

The angle member has first and second elongated, substantially perpendicular, angle flanges joined along a common edge forming the internal corner. An integral mounting flange extends substantially perpendicular to the first angle flange. The clamp tabs on the clamp member are secured to this first angle flange on the angle member by the clamping fasteners. The flat elongated body of the clamp member and the mounting flange of the angle member abut each other and have aligned mounting holes through which mounting fasteners extend to secure the angle member and the clamp member to the other of the door and the door jamb. The angle member and the clamp member are fabricated from sheet material by precision stamping and bending to produce components with very close tolerances. The open circular recesses in the clamping flanges are made tangent to the outer surface of the clamp tabs along one edge of the clamping flange forming the external corner and are also tangent to the other edge of the clamping flange forming the corner. This produces an open circular recess. The diameter of this open circular recess is less than the diameter of the hinge pin so that with the hinge pin received in the open circular recess, it is wedged against the internal corner of the angle member. The compression fit produced by this arrangement is tight enough to eliminate the sag in the door while still permitting relative movement between the hinge pin and the hinge housing.

The invention embraces both the hinge assembly and an enclosure for electrical apparatus including the novel hinge assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The present invention is directed to a hinge assembly for doors such as those used on enclosures for electrical apparatus. It is particularly suitable for short, wide doors and will be described as applied to the short, wide doors providing access to electrical terminations in a switchgear assembly.

Figure 1:
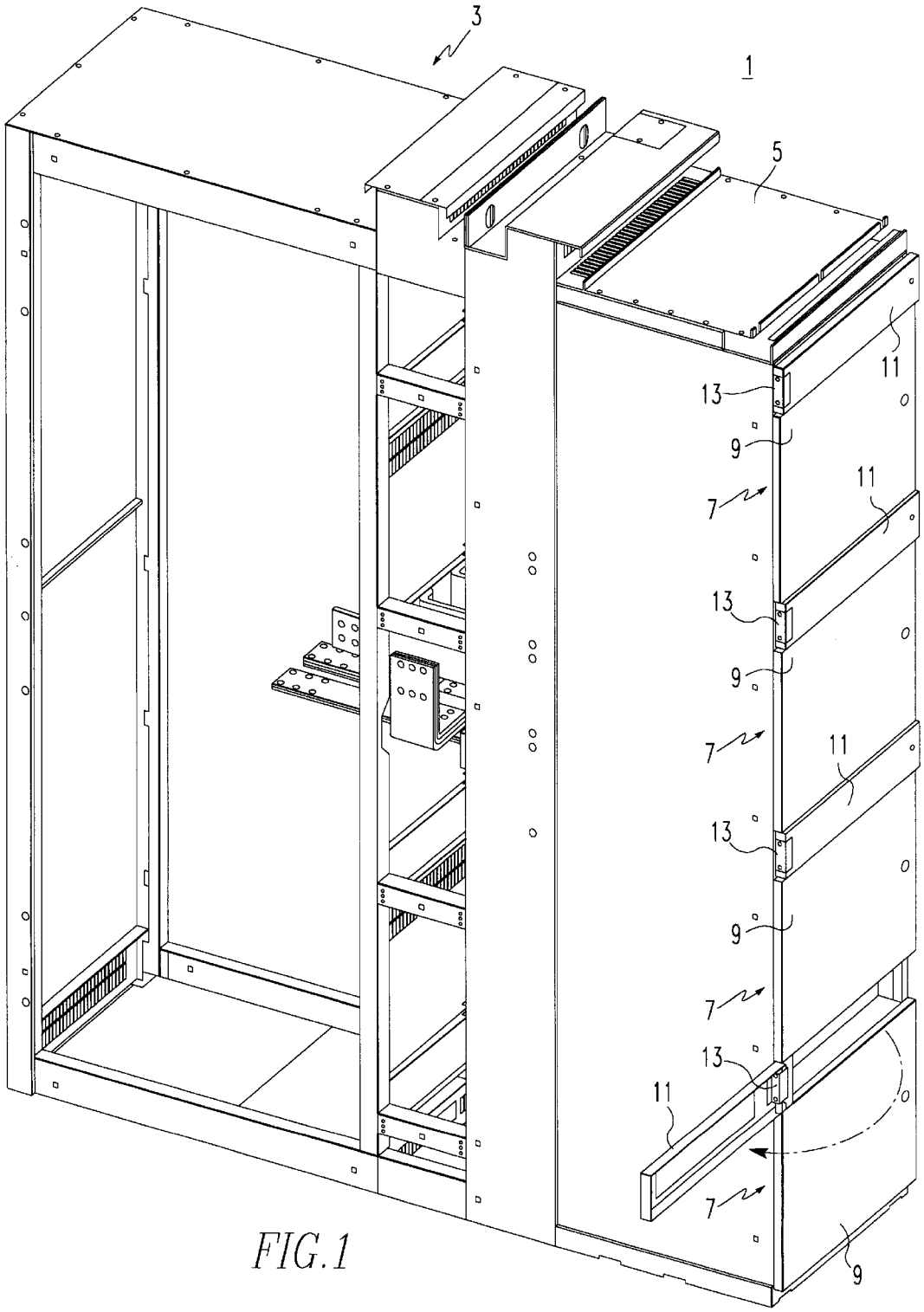
FIG. 1 is an isometric view of a switchgear enclosure incorporating the invention.

Referring to FIG. 1, the switchgear assembly 1 includes a metal cabinet or enclosure 3 having a front compartment 5 containing four cells 7 stacked one on top of another. Each of the cells 7 houses a piece of electrical apparatus (not shown) such as a circuit breaker or metering equipment which are accessible through conventional cell doors 9. Each cell 7 includes an electrical termination strip (also not shown) which is accessible through a separate door 11 at the top of the cell above the cell door 9. These electronic doors 11 are short and wide. For instance, the width of the door 11 can be four to five times or more the height. The doors 11 are hinged along one side edge. When conventional hinges are used for such short, wide doors, they tend to sag.

Figure 2:
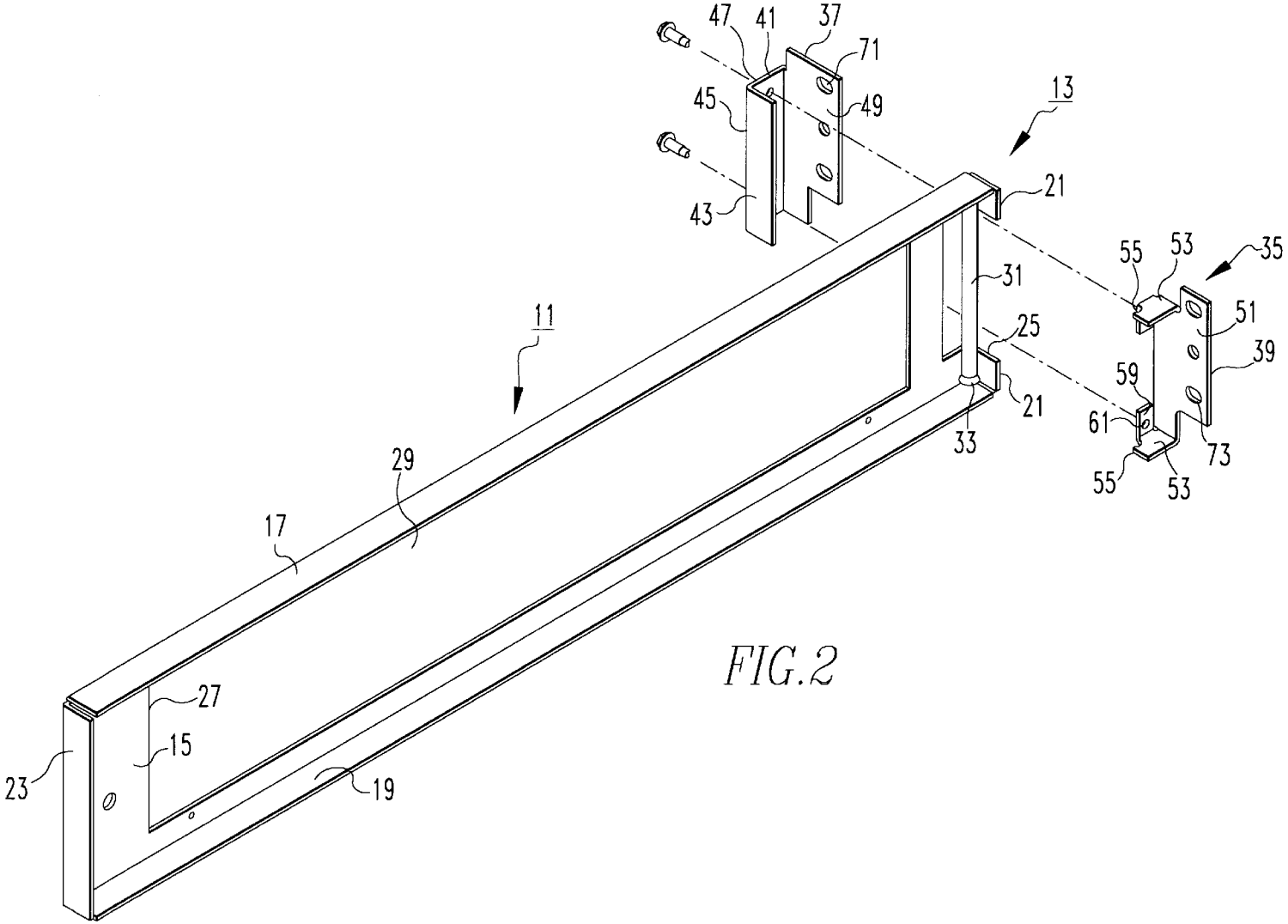
FIG. 2 is an exploded isometric view illustrating a hinge assembly in accordance with the invention incorporated into a door for the switchgear enclosure of FIG. 1.
Figure 3:
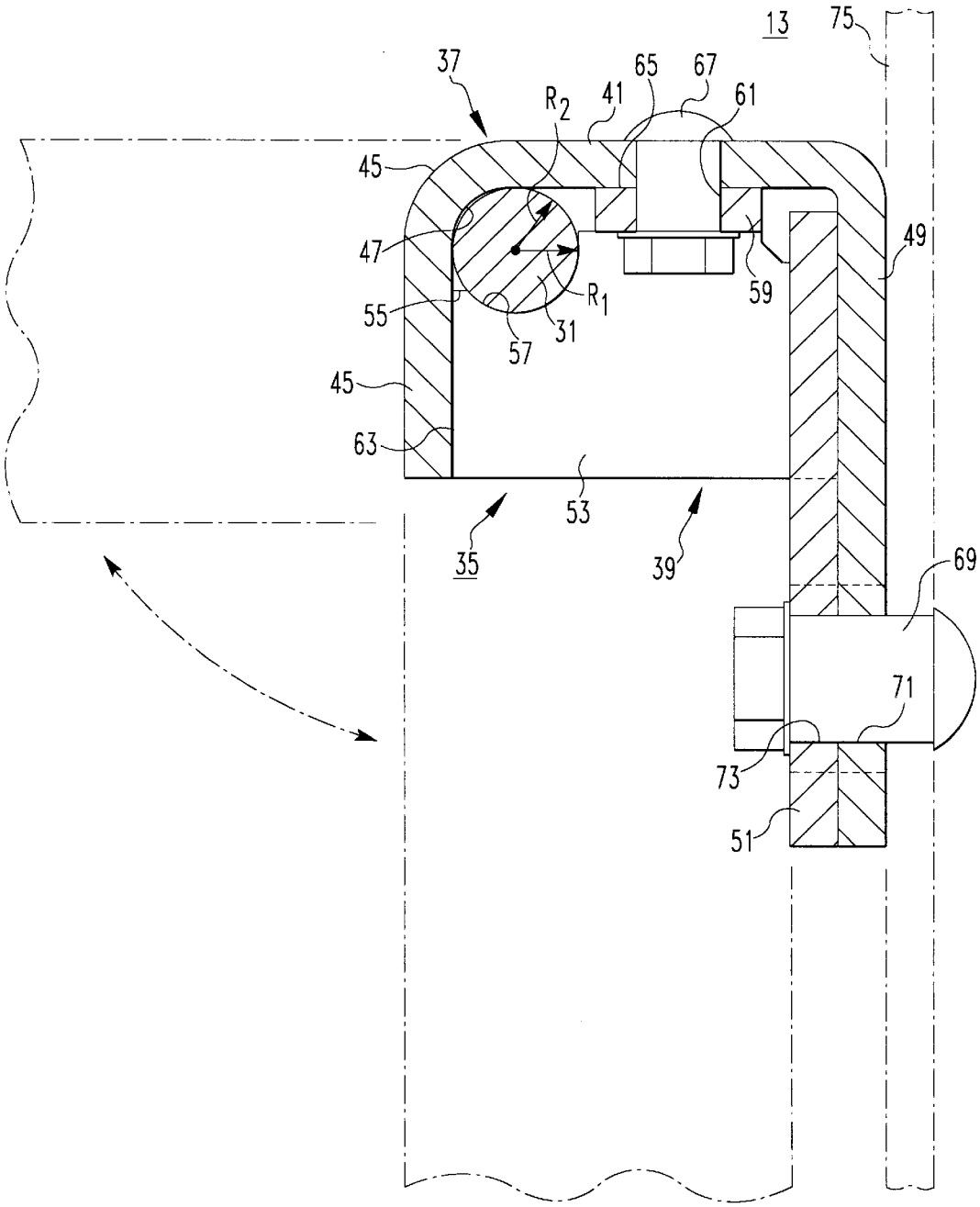
FIG. 3 is a horizontal sectional view through an assembled hinge assembly in accordance with the invention.
Figure 4:
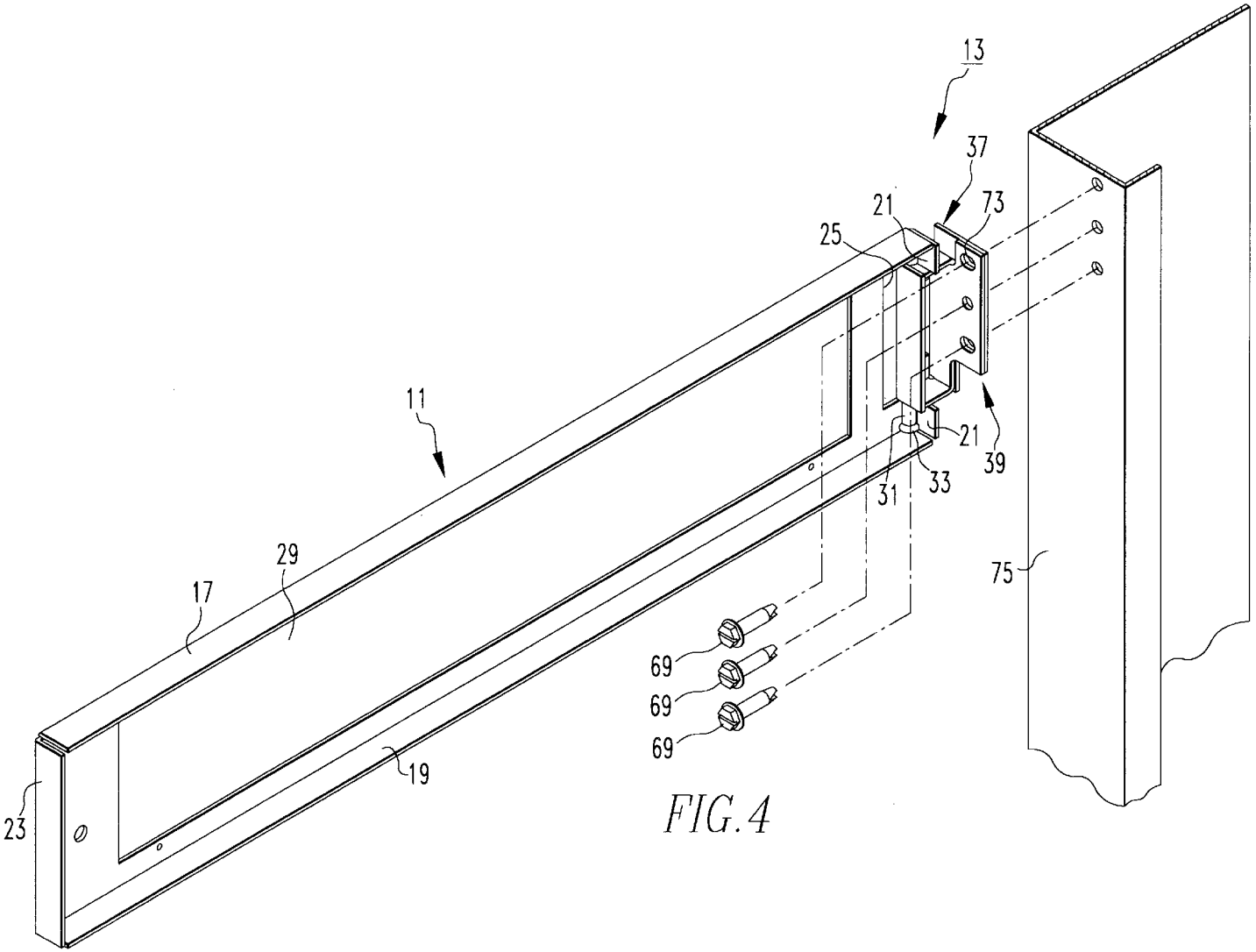
FIG. 4 is an exploded isometric view illustrating a hinge assembly in accordance with the invention assembled on the door and showing its mounting to the switchgear enclosure.

A hinge assembly 13 in accordance with the invention is illustrated in FIGS. 2–4. The door 11 has a sheet metal frame 15 with flanges 17 and 19 running along the top and bottom edges, and flanges 21 at the hinged end and 23 at the free end. A slot 25 extends through the flange 21 and into the frame 15. A central opening 27 in the frame 15 reduces the weight of the door 11 and can be covered by a lighter gage panel 29.

The hinge assembly 13 includes a hinge pin 31 which is nonrotationally fixed such as by welds 33 in the corners of the door 11 formed by the frame 15 and the flanges 17 and 21 at the top and 19 and 21 at the bottom.

The hinge assembly 13 also includes a hinge housing 35 which clamps against the hinge pin 31 yet permits relative rotation between the hinge pin and the housing. The hinge housing 35 includes a first or angle member 37 and a second or clamp member 39. The angle member 37 has first 41 and second 43 elongated, substantially perpendicular angle flanges joined along a common edge 45 forming an internal corner 47. A mounting flange 49 extends substantially perpendicular to the first flange 41 so that the angle member 37 is generally U-shaped.

The clamp member 39 has a flat, elongated body 51 with first and second clamping flanges 53 projecting laterally from opposite ends of the elongated body 51 in spaced parallel relation. These clamping flanges 53 form external corners 55 with aligned corner recesses 57. Integral clamping tabs 59 extend from the clamping tabs 53 adjacent the corner recesses 57 and are provided with apertures 61. The elongated body 51, the clamping flanges 53 and the clamping tabs 59 are in mutually orthogonal planes.

The clamp member 39 mates with the angle member 37 so that the fixed hinge pin 31 is clamped into the internal corner 47 of the angle member 37 by the corner recesses 57 in the clamping flanges 53 as best seen in FIG. 3. The corner recess 57 is an open circle which is tangent to one edge 63 of the clamping flanges and to the outer surface 65 of the clamping tabs 59. The radius $R_1$ of the corner recess 57 is slightly shorter than the radius $R_2$ of the fixed hinge pin 31. In the exemplary embodiment of the invention, the radius $R_1$ is 0.123 inches and the radius $R_2$ is 0.125 inches. This creates a compression fit between the hinge assembly 13 and the fixed hinge pin 31 at spaced apart points adjacent the top and the bottom of the hinge pin 31 which securely fixes the hinge pin axis but allows rotation of the hinge pin relative to the angle member 37 and clamp member 39.

The clamp member 39 is firmly secured to the angle member 37 by rivets 67 extending through the apertures 61 in the clamping tabs 59. In addition, the elongated body 51 of the clamp member is firmly secured against the mounting flange 49 of the angle member 37 by mounting rivets 69 which extend through mounting holes 71 in the mounting flange 49 and 73 in the elongated body 51 and attach the hinge assembly 13, and therefore the door 11, to an upright 75 forming a door jam on the cabinet 3. The orthogonal orientation of the elongated body 51, clamping flanges 53 and clamping tabs 59 of the clamp member 39 and the close proximity of the clamping tabs 59 to the corner recesses 57 in which the hinge pin 31 is retained, assure a good compression fit of the hinge assembly on the hinge pin 31.

While in the exemplary embodiment of the invention the hinge pin 31 is nonrotationally fixed on the door 11, and the hinge housing is fixed to the door jam, it should be understood that the hinge pin could be nonrotationally fixed to the door jam and the hinge housing could be mounted on the door.

It will be noted that the hinge housing extends through the slot 25 in the door frame 15 and end flange 21, and that with the door closed the outer surface of the flange 41 on the angle member 37 is flush with the outer surface of the door, while the outer surface of the second flange 43 is flush with the flange 21.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A hinge assembly for pivotally connecting a door to a door jamb of an enclosure for electrical apparatus, said hinge assembly comprising:

a hinge pin generally circular in cross section, non-rotationally fixable to one of said door and door jamb, said hinge pin having a fixed diameter;

a hinge housing fixable to the other of said door and door jamb and clamping against said hinge pin with a compression fit which permits relative rotation between said hinge pin and said hinge housing;

wherein said hinge housing comprises a first member and a second member which clamp said hinge pin between them;

wherein said first member is an angle member forming an internal corner and said second member is a clamp member which clamps said hinge pin into said internal corner of said angle member; and wherein said clamp member has an external corner which nests into said internal corner on said angle member, said clamp member having a corner recess in said external corner with a maximum dimension which is smaller than a said diameter of said hinge pin and in which said hinge pin is received and wedged into said internal corner of said angle member.

2. The hinge assembly of claim 1 wherein said corner recess at said external corner of said clamp member is an open circle and said maximum dimension is the diameter of said open circle.

3. A hinge assembly for pivotally connecting a door to a door jamb of an enclosure for electrical apparatus, said hinge assembly comprising:

a hinge pin non-rotationally fixable to one of said door and door jamb;

a hinge housing fixable to the other of said door and door jamb and clamping against said hinge pin with a compression fit which permits relative rotation between said hinge pin and said hinge housing;

wherein said hinge housing comprises a first member and a second member which clamp said hinge pin between them;

wherein said first member is an angle member forming an internal corner and said second member is a clamp member which clamps said hinge pin into said internal corner of said angle member; and wherein said clamp member has a flat elongated body with first and second clamping flanges projecting from adjacent opposite ends of said elongated body forming spaced apart external corners with aligned corner recesses which nest with said internal corner of said angle member to clamp said hinge pin at two spaced apart locations.

4. The hinge assembly of claim 3 wherein said clamp member includes clamp tabs on said clamping flanges adjacent said corner recesses and clamping fasteners securing said clamp tabs to said angle member adjacent said internal corner.

5. The hinge assembly of claim 4 wherein said clamp tabs are substantially perpendicular to both said clamping flanges and said flat elongated body of said clamp member.

6. The hinge assembly of claim 5 wherein said angle member has first and second elongated substantially perpendicular angle flanges joined along a common edge forming said internal corner, and a mounting flange substantially perpendicular to said first angle flange, said clamp tabs on said clamp member being secured to said first angle flange on said angle member by said clamping fasteners, said flat elongated body of said clamp member and said mounting flange of said angle member having aligned mounting holes, and including mounting fasteners extending through said mounting holes to secure said angle member and said clamp member to the other of said door and door jamb.

7. The hinge assembly of claim 5 wherein said clamp tabs have an outer surface and said corner recesses are circular and substantially tangent to said outer surfaces of said clamp tabs.

8. The hinge assembly of claim 7 wherein said circular corner recesses are also substantially tangent to an adjacent edge of said clamping flanges forming said external corners.

9. The hinge assembly of claim 8 wherein said hinge pin is generally circular in cross section and has a hinge pin diameter, wherein said circular corner recesses have a diameter smaller than said hinge pin diameter.

10. The hinge assembly of claim 9 wherein said door has a width greater than a height.

11. The hinge assembly of claim 4 wherein said clamping fasteners are rivets.

12. An enclosure for electrical apparatus comprising:

a housing having a door with a width greater than a height and a door jamb; and a hinge assembly pivotally connecting said door to said door jamb and comprising:

a hinge pin non-rotationally fixed to one of said door and said door jamb; and a hinge housing fixed to the other of said door and door jamb and comprising:

an angle member forming an internal corner; and a clamp member comprising an elongated body and first and second clamping flanges extending from adjacent opposite ends of said elongated body forming spaced apart external corners with aligned corner recesses at said external corners which nest with said internal corner of said angle member to clamp said hinge pin at two spaced apart locations.

13. The enclosure of claim 12 wherein said clamp member includes clamp tabs extending from said clamping flanges adjacent said corner recesses, and clamping fasteners securing said clamp tabs to said angle member adjacent said internal corner.

14. The enclosure of claim 13 wherein said clamp tabs are perpendicular to both said clamping flanges and said elongated body, and wherein said angle member comprises first and second substantially perpendicular angle flanges joined along a common edge to form said internal corner, and a mounting flange on said angle member extending substantially perpendicular from said first angle flange, said mounting flange of said angle member and said elongated body of said clamp member abutting each other and being secured to the other of said door and said door jamb.

15. The enclosure of claim 14 wherein said corner recesses in said clamping flanges are open circles having a radius less than a radius of said hinge pin.

16. The enclosure of claim 14 wherein said door has an end flange adjacent one end and top and bottom flanges to which said hinge pin is non-rotational fixed adjacent said end flange, said door having a slot extending centrally through said end flange and into said door, said hinge housing extending through said slot and sized such that with said door closed said first flange on said angle member is substantially flush with said end flange on said door and second flange on said angle member is substantially flush with a front surface of said door.

* * * * *